United States Patent [19]

Nakamura et al.

[11] Patent Number: 5,071,113

[45] Date of Patent: Dec. 10, 1991

[54] APPARATUS AND METHOD FOR TRANSPORTING SHEET PAPER

[75] Inventors: Yasunori Nakamura, Owariasahi; Shigeki Numata, Kasugai; Kenji Mori, Tsuchiura, all of Japan

[73] Assignee: Hitachi, Ltd., Tokyo, Japan

[21] Appl. No.: 513,912

[22] Filed: Apr. 24, 1990

[30] Foreign Application Priority Data

Apr. 26, 1989 [JP] Japan ..... 1-107072

[51] Int. Cl.[5] ..... B65H 5/12

[52] U.S. Cl. ..... 271/267; 271/270; 271/193; 198/747; 198/736; 226/137; 226/139; 226/158; 340/674

[58] Field of Search ..... 271/193, 262, 263, 265; 198/747, 736; 226/137, 139, 158; 340/674, 266, 267, 268, 270

[56] References Cited

U.S. PATENT DOCUMENTS

| | | | |
|---|---|---|---|
| 3,747,921 | 7/1973 | Knappe | 271/266 |
| 3,929,328 | 12/1975 | Knappe et al. | 271/267 |
| 4,605,217 | 9/1986 | Goi | 271/263 X |
| 4,917,512 | 4/1990 | Mimura et al. | 271/263 X |

FOREIGN PATENT DOCUMENTS

| | | | |
|---|---|---|---|
| 48507 | 7/1985 | Japan | 271/262 |
| 48611 | 11/1986 | Japan | 271/262 |
| 48912 | 12/1989 | Japan | 271/193 |

OTHER PUBLICATIONS

NE Report, Nikkei Electronics, No. 446, published May 2, 1988, pp. 74–75. This document is provided in Japanese. An English translation is unavailable to applicants' attorney.

*Primary Examiner*—H. Grant Skaggs
*Assistant Examiner*—Carol Lynn Druzbick
*Attorney, Agent, or Firm*—Fay, Sharpe, Beall, Fagan, Minnich & McKee

[57] ABSTRACT

A sheet paper feed unit comprises an actuator, which is formed of a piezoelectric device, and an idling roller, and sheet paper is clamped between the actuator and idling roller and transported by the vibration of the piezoelectric device. A control unit determines information pertinent to a parameter specific to the sheet paper to be transported, and imparts a drive condition which complies with the information to the piezoelectric drive unit. The piezoelectric device is activated in the condition which complies with the paper specific parameter, whereby the sheet paper is transported at a stable speed.

5 Claims, 4 Drawing Sheets

FIG. 3

FIRST CONTROL TABLE

| THICKNESS | DRIVE VOLTAGE |
|---|---|
| $t_1$ | $e_1$ |
| $t_2$ | $e_2$ |
| $t_3$ | $e_3$ |
| $t_4$ | $e_4$ |
| $t_5$ | $e_5$ |
| | |
| $t_n$ | $e_n$ |

13

FIG. 4

SECOND CONTROL TABLE

| THICKNESS | GAP |
|---|---|
| $t_1$ | $g_1$ |
| $t_2$ | $g_2$ |
| $t_3$ | $g_3$ |
| $t_4$ | $g_4$ |
| $t_5$ | $g_5$ |
| | |
| $t_n$ | $g_n$ |

14

FIG. 5

| SPEED DIFFERENCE | THICKNESS |
|---|---|
| $V_1$ | $t_1$ |
| $V_2$ | $t_2$ |
| $V_3$ | $t_3$ |
| $V_4$ | $t_4$ |
| $V_5$ | $t_5$ |
| | |
| $V_n$ | $t_n$ |

15

APPARATUS AND METHOD FOR TRANSPORTING SHEET PAPER

BACKGROUND OF THE INVENTION

This invention relates to an apparatus and method for transporting sheet paper, and more particularly to a sheet paper transportation apparatus and method using a piezoelectric device as a source of drive force.

Conventional sheet paper transportation mechanism used in the office automation (OA) equipment or the like is based on the feed roller which is driven by a stepping motor or the like through gears or a belt.

However, the simplification of the sheet paper transportation mechanism is requested as the OA equipment becomes compact. As means of accomplishing this requirement, developments of sheet paper transportation mechanisms which directly feed sheet paper by use of a piezoelectric device are under way. Refer to the NE report in publication "Nikkei Electronics", No. 446, pp. 74–75, published on May 2, 1988.

Although it is indispensable for a sheet paper transportation mechanism to provide a stable feed speed and feed value, a sheet paper transportation mechanism using a piezoelectric device, which bases the drive force on the friction between the vibrating actuator and the vibrated sheet paper when coming in contact with each other, creates a difference of feed speed depending on the gap between the vibrating member and the sheet paper the pressure acting on these members, and the properties (thickness, stiffness, etc.) of the sheet paper.

SUMMARY OF THE INVENTION

An object of this invention is to provide an apparatus for transporting various sheet papers having different properties at a stable feed speed.

Another object of this invention is to provide an apparatus and method for transporting sheet paper in the condition which complies with the parameter inherent to the sheet paper.

The inventive feed unit comprises an actuator, which is made of piezoelectric device, and an idling roller. Sheet paper is clamped between the actuator and the idling roller, and it is transported by the application of piezoelectric vibration. A control unit determines information pertinent to the paper specific parameter (the thickness of sheet paper, preferably), and imparts the drive condition based on this information to a piezoelectric drive unit. The piezoelectric device is activated in the condition based on the paper specific parameter, and the sheet paper is fed at a stable feed speed.

The inventive sheet paper transportation method activates the piezoelectric device in a predetermined standard condition, and identifies the paper specific parameter from the resulting feed speed. Subsequently, the piezoelectric device is activated in the condition based on the identified parameter thereby to transport the sheet paper.

BRIEF DESCRIPTION OF THE DRAWINGS

FIGS. 3 to 5 are diagrams showing specific examples of the tables shown in FIG. 1.

DESCRIPTION OF THE PREFERRED EMBODIMENT

An embodiment of this invention will be described in detail with reference to the drawings.

Figure 2:
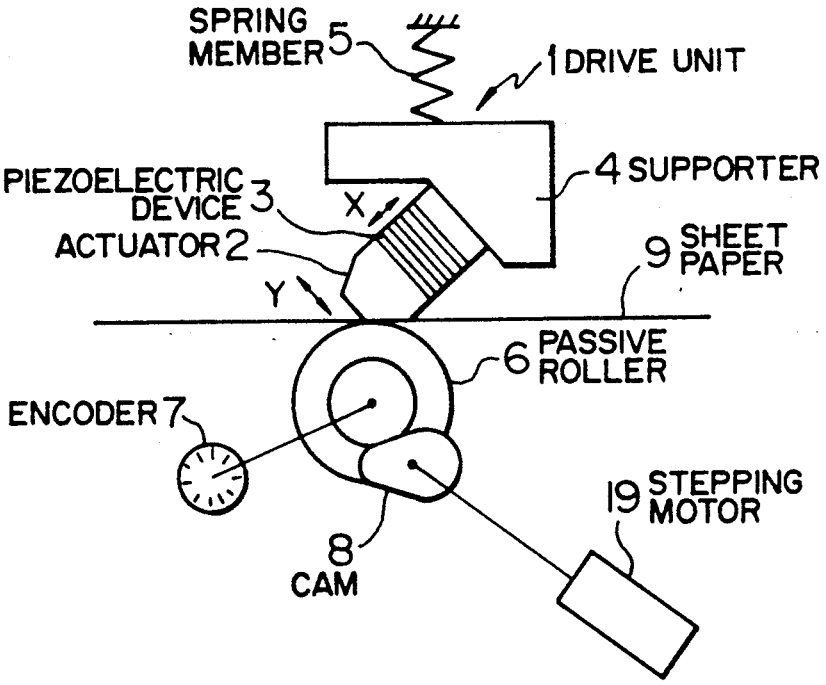
FIG. 2 is a diagram showing an embodiment of the feed unit in the sheet paper transportation apparatus shown in FIG. 1.

FIG. 2 shows the feed unit of the sheet paper transportation apparatus. A drive unit 1 comprises a supporter 4 and an actuator which is fixed on the supporter 4. The actuator comprises a piezoelectric drive 3. An idling roller 6 is disposed to press the actuator and sheet paper 9. The drive unit 1 is pressed to the idling roller 6 by means of a spring member 5. The idling roller 6 is coupled directly with an encoder 7, which detects the rotation of the idling roller 6 thereby to measure the feed speed of the sheet paper 9. The idling roller 6 is in contact with a cam 8, which is turned by a stepping motor 19 so that the idling roller 6 is moved vertically on the drawing, thereby adjusting the gap or pressing force between the idling roller 6 and the actuator 2.

With the sheet paper 9 being clamped between the actuator 2 and idling roller 6, when an a.c. voltage is applied to the piezoelectric device 3, it generates an ultrasonic vibration, inducing the actuator 2 to produce an ultrasonic vibration in the X direction in the figure. This vibration in the X direction causes the actuator 2 to receive pulsative counter forces from the sheet paper 9 which is in contact with the actuator 2, and it vibrates in the Y direction in the figure. By the combination of these vibrations, the sheet paper 9 is transported directly.

Figure 1:
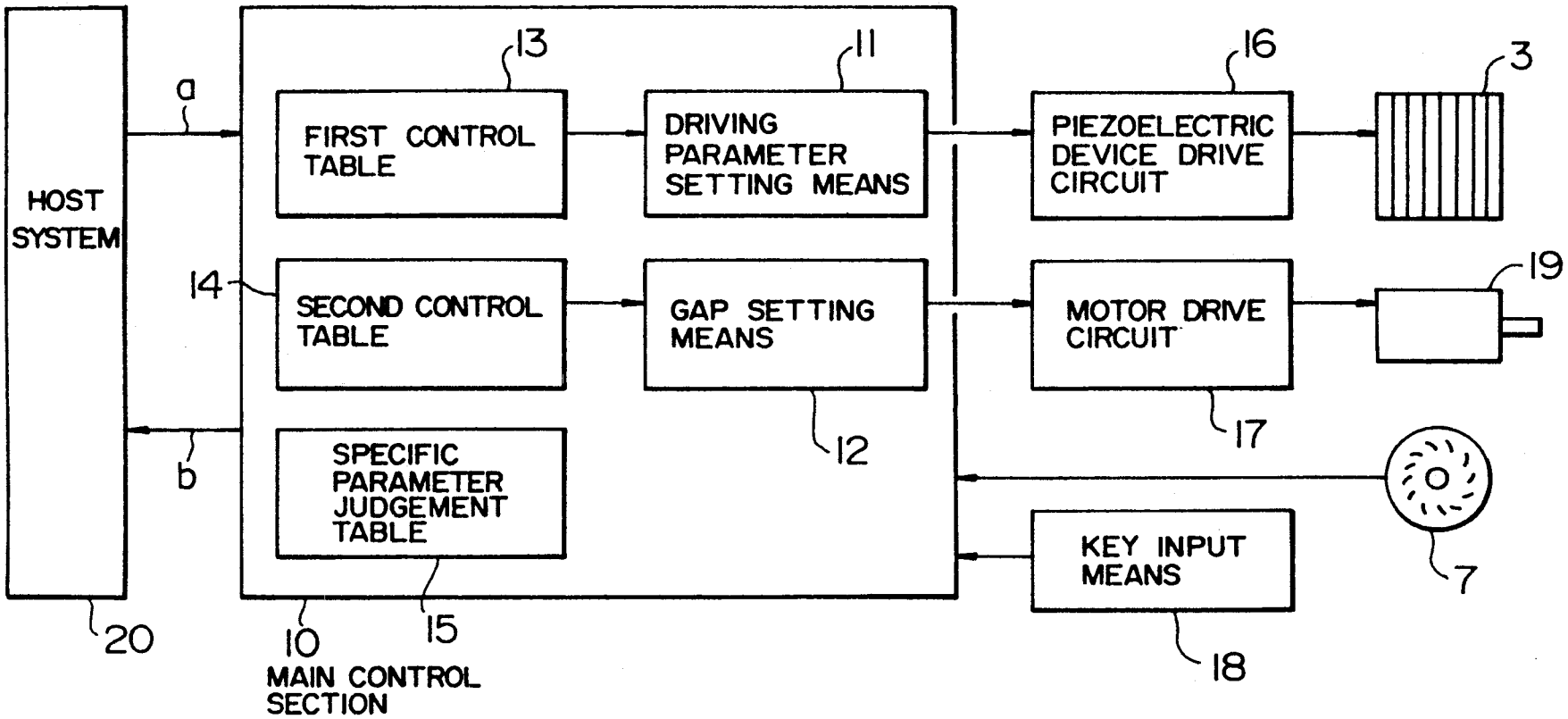
FIG. 1 is a block diagram showing the sheet paper transportation apparatus embodying the present invention.

FIG. 1 shows the arrangement of the control unit of the sheet paper transportation apparatus which embodies the present invention. In the figure, indicated by 10 is a main control section, which comprises a driving parameter setting means 11 for setting a electrical drive condition such as the drive voltage or drive current applied to the piezoelectric device 3, a gap setting means 12 for setting a gap between the idling roller 6 and the actuator 2, and three tables which will be described below. The first table is a first control table 13 which relates parameters specific to various sheet papers 9 to drive conditions of the piezoelectric device 3 for transporting the sheet papers 9 at a prescribed feed speed, i.e., a relational table to be set in the above-mentioned drive parameter setting means 11, obtained during the development of the apparatus. The second table is a second control table 14 which relates the sheet paper parameters to pressing forces or gaps between the idling roller 6 and the actuator 2, i.e., a relational table to be set in the above-mentioned gap setting means 12, obtained during the development of the apparatus. The third table is a parameter judgement table 15 which relates the sheet paper parameters to differences of speed from the standard feed speed when the sheet papers are fed in accordance with the standard values of the first control table 13 and second control table 14 obtained during the development or manufacturing of the apparatus.

FIGS. 3 to 5 are specific examples of the contents of the first control table 13, second control table 14 and parameter judgement table 15 mentioned above. The first control table 13 shown in FIG. 3 relates the thickness t of sheet paper 9, as a paper specific parameter, to the drive voltage e, as a drive condition of the piezoelectric device 3, and it is designed to determine an optimal drive voltage of the piezoelectric device 3 from among $e_1, e_2, \ldots, e_n$ from a given thickness out of $t_1, t_2, \ldots, t_n$ for transporting the sheet paper 9 at the prescribed feed speed.

The second control table 14 shown in FIG. 4 relates the thickness t of sheet paper, as a paper specific parameter, to the gap g between the actuator 2 and the idling roller 6, and it is designed to determined an optimal gap between the actuator 2 and the idling roller 6 from among $g_1, g_2, \ldots, g_n$ from a given thickness out of $t_1, t_2, \ldots, t_n$ for transporting the sheet paper 9 at the prescribed feed speed.

The parameter judgement table 15 shown in FIG. 5 relates the thickness t, as a paper specific parameter, to the difference of speed from the standard feed speed when the sheet paper is fed in accordance with the standard drive voltage $e_{st}$ and standard gap $g_{st}$ between the actuator 2 and idling roller 6, and it is designed to determine a thickness from among $t_1, t_2, \ldots, t_n$ from a given speed difference out of $v_1, v_2, \ldots, v_n$ with respect to the standard feed speed when the sheet paper 9 is fed at the drive voltage $e_{st}$ applied to the piezoelectric device 3 and the gap $g_{st}$ between the actuator 2 and idling roller 6.

Indicated by 16 is a piezoelectric device drive circuit which activates the piezoelectric device 3 in accordance with the value set in the driving parameter setting means 11, and 17 in a motor drive circuit which drives the stepping motor 19 in accordance with the value set in the gap setting means 12 thereby to make the gap between the actuator 2 and idling roller 6 equal to the value set in the gap setting means 12.

The main control section 10 receives the signal from the encoder 7 and measures the sheet paper feed speed based on the signal. The main control section 10 is connected with a key input means 18, by which the operational condition of the apparatus and paper specific parameter can be set.

Figure 6:
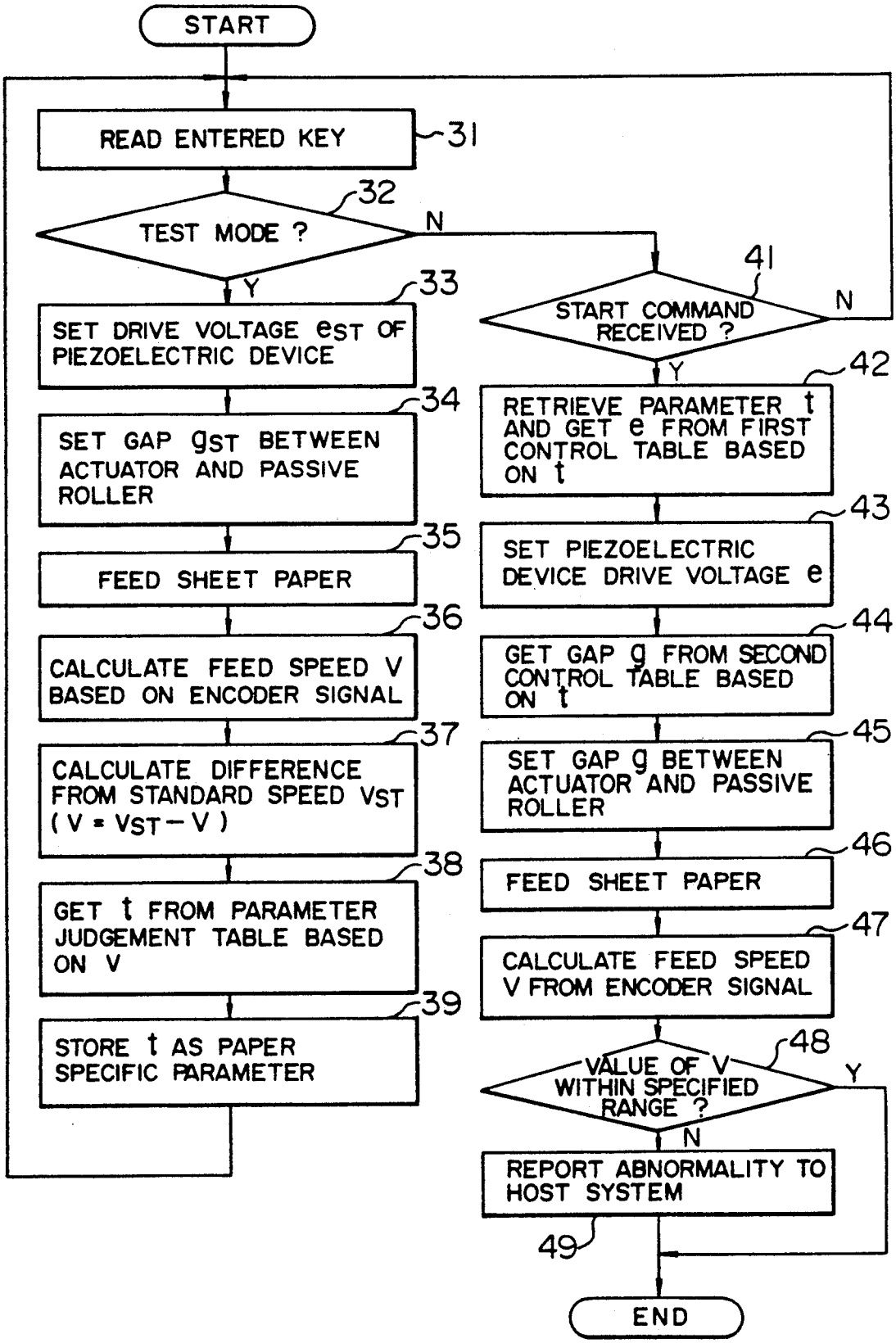
FIG. 6 is a flowchart showing an example of the control procedure implemented by the main control unit shown in FIG. 1.

FIG. 6 shows in flowchart the control operation of the control unit 10. Initially, the test mode of the apparatus is set on the key input means 18, and a sheet paper 9 to be used is fed (steps 31 and 32). The driving parameter setting means 11 and gap setting means 12 have the values which have been used for creating the parameter judgement table 15 (steps 33 and 34). The feed speed of the sheet paper 9 under test is entered as the encoder signal to the main control section 10 (steps 35 and 36).

Based on the signal from the encoder 7, the main control section 10 evaluates the difference between the standard feed speed and the actual feed speed of the sheet paper 9, and searches the parameter judgement table 15 by using the speed difference as a key (steps 37 and 38) thereby to determine and store a parameter specific to the sheet paper 9 which has been fed (step 39).

Next, the operation mode of the apparatus is set on the key input means 18. In this mode, upon receiving the feed start command a from a host system 20 (steps 31 and 41), the first control table 13 and second control table 14 are searched based on the paper specific parameter which has been stored in the test mode (steps 42 and 44) so as to determine values to be set in the driving parameter setting means 11 and gap setting means 12, and these values are set (steps 43 and 45). Based on the set values, the piezoelectric device drive circuit 16 activates the piezoelectric device 3. Based on the value set in the gap setting means 12, the idling roller 6 is positioned to have the optimal gap with the actuator 2 by means of the cam 8, stepping motor 19 and motor drive circuit 17.

Although in the above explanation the paper specific parameter is determined through the test feed, it is also possible to store the paper specific parameter directly in the apparatus by using the key input means 18 when the quality and thickness of the sheet paper 9 are known. In case the type of sheet paper 9 is determined from the job, it is possible to enter a job code on the key input means or send it from the host system thereby to determine the paper specific parameter.

After the drive condition of the piezoelectric device 3 and the gap between the actuator 2 and idling roller 6 have been set following the determination of the paper specific parameter, the sheet paper feed speed is detected by the encoder 7 and it is compared with the standard speed by the main control section 10 (steps 46 and 47). If the difference is greater than the predetermined value, a signal b is delivered to the host system 20 (steps 48 and 49), allowing it to detect the double feeding of sheet papers or the feeding of an incorrect sheet paper. When the difference is within the predetermined range, nothing takes place.

Although in the above embodiment the encoder 7 is used for detecting the sheet paper feed speed, it can be replaced with other method. For example, such detection means as photo-interrupt sensors are disposed on the sheet paper feed path so that the feed speed is measured from the time of passage of the sheet paper.

As described above in detail, the optimal value of the electrical drive condition, such as the drive voltage, of the piezoelectric device, the gap between the actuator and idling roller, or the pressing force of the idling roller to the actuator is set against a material specific parameter such as the thickness or stiffness of sheet paper in transporting the sheet paper, and a sheet paper transportation apparatus capable of transporting various sheet papers having different properties at a stable speed can be realized.

We claim:

1. A sheet paper transportation apparatus comprising:

transportation means including an actuator made up of a piezoelectric device, an idling roller and adjustment means for adjusting the gap between said actuator and idling roller for transporting sheet paper, which is clamped between said actuator and idling roller, in response to the vibration of said piezoelectric device;

drive means for driving said piezoelectric device electrically;

control means including a first table which contains a plurality of pairs of information pertinent to parameters specific to said sheet papers and electrical drive conditions, a second table which contains a plurality of pairs of information pertinent to parameters specific to said sheet papers and values of said gap, and a third table for judging said sheet paper specific parameters;

entry means for detecting a state of transportation of said sheet paper transported by said transportation means and entering a result of detection to said control means;

said control means judging said specific parameters by using said third table on a basis of a transportation state provided by said entry means when said piezoelectric device is driven in accordance with a predetermined standard condition, determining said electrical drive condition and gap value in said first and second tables in response to the judged specific parameter, and imparting the determined condition and value to said drive means and said adjusting means.

2. The sheet transportation apparatus of claim 1 wherein the specific parameter judged by the control means is the feed speed of the sheet paper.

3. A method of transporting sheet paper in which the sheet paper is clamped between an actuator, which comprises a piezoelectric device, and an idling roller and transported by the vibration of said piezoelectric device, said method comprising:

a first step of driving said piezoelectric device in a predetermined standard condition thereby to transport said sheet paper;

a second step of determining a parameter specific to said sheet paper from the sheet paper transportation speed in said first step; and a third step of driving said piezoelectric device in a condition which complies with said determined specific parameter thereby to transport said sheet paper.

4. The method of transporting sheet paper of claim 3 wherein said determined specific parameter is the feed speed of the sheet paper.

5. A method of transporting sheet paper in which the sheet paper is clamped between an actuator, which comprises a piezoelectric device, and an idling roller, with the gap between said actuator and idling roller being adjusted, and transported by the vibration of said piezoelectric device, said method comprising:

a first step of making a predetermined gap between said actuator and idling roller and driving said piezoelectric device in a predetermined standard condition thereby to transport said sheet paper;

a second step of determining a parameter specific to said sheet paper from a sheet paper transportation speed in said first step; and a third step of adjusting the gap between said actuator and idling roller in accordance with said determined specific parameter and driving said piezoelectric device in a condition which complies with said determined specific parameter thereby to transport said sheet paper.

* * * * *